United States Patent [19]

Delonghi

[11] Patent Number: 4,497,415

[45] Date of Patent: Feb. 5, 1985

[54] NON-REFILLABLE AND INVIOLABLE BOTTLE-CAP

[75] Inventor: Adriano G. Arona Delonghi, Monterrey, Mexico

[73] Assignee: Fabrication De Maquinas, S.A., Monterrey, Mexico

[21] Appl. No.: 576,868

[22] Filed: Feb. 3, 1984

[30] Foreign Application Priority Data

Feb. 4, 1983 [MX] Mexico ..... 196169

[51] Int. Cl.[3] ..... B65D 49/02

[52] U.S. Cl. ..... 215/21; 215/272; 220/319

[58] Field of Search ..... 215/21, 252, 272; 220/203, 303, 86 NR, 85 Y, 85 SP, 319, 320

[56] References Cited

U.S. PATENT DOCUMENTS

| | | | |
|---|---|---|---|
| 2,949,205 | 8/1960 | Fitz, Jr. | 215/272 |
| 3,810,558 | 5/1974 | Crisp et al. | 215/21 |
| 4,192,428 | 3/1980 | Segmuller | 215/272 X |
| 4,232,795 | 11/1980 | Vigna | 215/21 |
| 4,359,166 | 11/1982 | Dubach | 215/272 |
| 4,382,520 | 5/1983 | Aleff | 215/21 |

*Primary Examiner*—Steven M. Pollard

*Attorney, Agent, or Firm*—Abelman, Frayne, Rezac & Schwab

[57] ABSTRACT

This invention is related to an improved, non-refillable and inviolable cap for bottles and other similar containers, featured by a combination of the following components: a valve-seat designed to be hermetically coupled to the container's mouth, same which encompasses a valve-seat flexible flange, a hollow bottom, a guiding, central-vertical projection, and a vertical, annular retention-member, with an interlocking-surface on one end; a valve formed by an elongate body with a central, vertical cavity on its lower end, which loosely receives the vertical projection of the seat; and a conical sealing-wall that surrounds the body and rests upon the valve-seat flange; an externally-threaded spout including an internal interlocking-surface, which cooperates with the interlocking-surface of the seat's retention-member, an external, intermediate and downward-oriented interlocking-surface; a plurality of protuberances (legs), all with external interlocking-surfaces on their lower ends; and an internal, central ring pending from the upper wall, aimed to guide and retain the valve when this is open.

10 Claims, 3 Drawing Figures

NON-REFILLABLE AND INVIOLABLE BOTTLE-CAP

BACKGROUND OF THE INVENTION

One of the major functions of non-refillable and inviolable caps is to offer certain reliability in that the bottled-products using these caps may get to consumers with the same quality as when they left the bottling-machine, thus preventing any alteration (or adulteration) while in transit and before reaching consumers.

The business of non-refillable and inviolable caps is broad and there is a wide range of cap-designs which fulfill their function more or less effectively.

Since the manufacture of caps requires individual moldings, machines and operators for each component thereof, the technological trend of making the function of the caps more effective by simplifying and reducing the number of elements which constitute the same and, even more important, by simplifying the assembling operations where it is necessary to use additional machinery and materials such as ultrasonic-soldering machines and glue continues nowadays.

The above-cited objectives have been achieved only in part in the field, owing mainly to the design characteristics of caps' components.

An example of this type of non-refillable and inviolable caps is that claimed by the Mexican Pat. No. 134542, which includes the well-known components that follow: valve-seat, valve, valve-retention bell (hood), spout, tube and threaded cap.

Notwithstanding the said patent describes the aforecited cap and tube as segments which have been put together so as to constitute only one piece, it is practically impossible to mold it as such, therefore being necessary to solder them together by using an ultrasonic-soldering machine or by any other means; thus increasing the number of the components up to six.

Considering this background, the author of the invention claimed hereby has found that, in order to avoid the use of additional machinery and materials for assembling the caps, it is—necessary to create a combination of components which might be able to attain a flexible coupling among themselves during their purely mechanical assembling-process and which, once assembled, might be able to remain firmly interlocked and fastened, with no possibility of being disassembled but by the necessary breaking of same, indicating thereby the violation thereof.

Furthermore, the inventor has found that, in order to reduce the number of components, it is necessary to re-design and simplify the same in a way which permits their manufacture by means of one machine only: the mechanical assembling one, thereby avoiding the problems of efficiency of the machine and, therefore, reducing the number of steps to be taken and of machines to be used.

The objectives described in the preceding paragraph were achieved by the author of the invention hereby claimed, by designing a novel valve which does not require the inclusion of the well-known valve-retention bell (hood), thereby reducing the number of components down to five, by providing a combination of interfastening-elements among the cap's components, with every one of them being totally manufactured or molded in their respective machines, allowing their purely mechanical assembling and interfastening, without resorting to any additional machinery or materials, and fulfilling their function with a maximum of efficiency, in view of their simplicity.

PURPOSES OF THE INVENTION

Therefore, it is a major purpose of the invention claimed hereby, to provide an improved, non-refillable and inviolable cap, the components of which are capable of attaining a flexible coupling among them during their purely mechanical asembling-process, and which, once assembled, are firmly interlocked and fastened, with no possibility of being disassembled but by the necessary breaking of same, indicating thereby the violation thereof, thus avoiding the use of additional machinery and/or materials for their assembling.

Another major purpose of the invention claimed hereby is to provide an improved, non-refillable and inviolable cap, of the nature heretofore depicted, with fewer components which may be manufactured wholly in their respective machines, thereby permitting a more efficient fulfillment of their functions.

These and other purposes and advantages of the present invention shall be evident to the experts in the field from the detailed description of same, which shall be made with reference to the specific modalities thereof, by way of illustration and not of limitation of the recited invention.

DESCRIPTION OF THE SPECIFIC MODALITIES OF THE INVENTION

Figure 1:
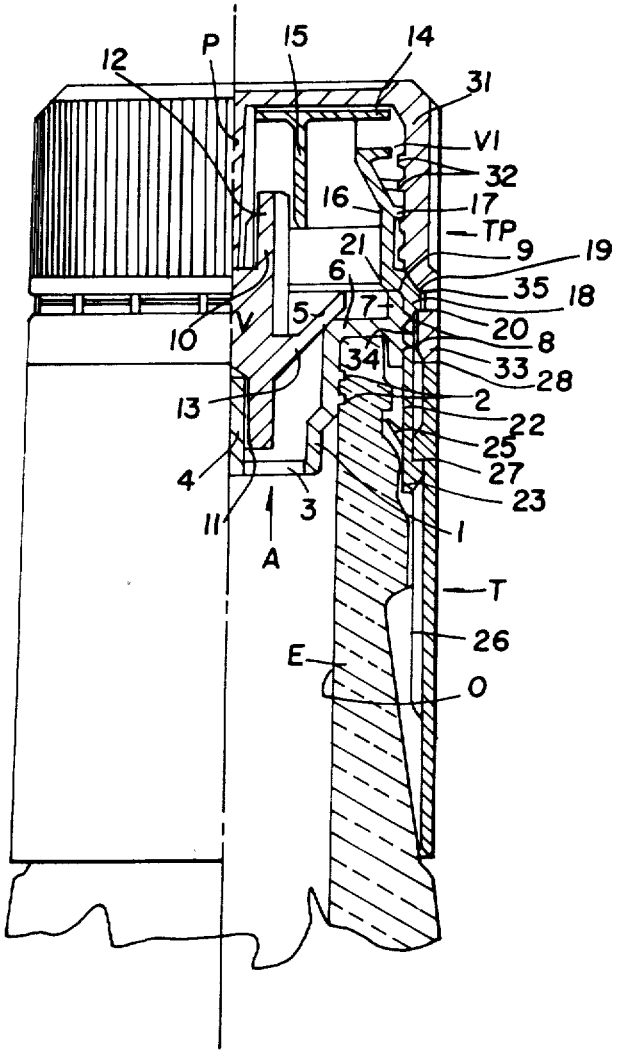
FIG. 1 is an elevation and a partial longitudinal-section-view of a first modality of the improved, non-refillable and inviolable cap claimed hereby, showing all of its components intercoupled.

The specific modalities of the invention which appear in the drawings annexed hereto as illustrations thereof, where numbers refer to the same parts of the figures included shall be hereafter described, depicting so as to simplify the illustration all of the components of the different modalities in the first place, and their intercoupling afterwards.

Figure 2:
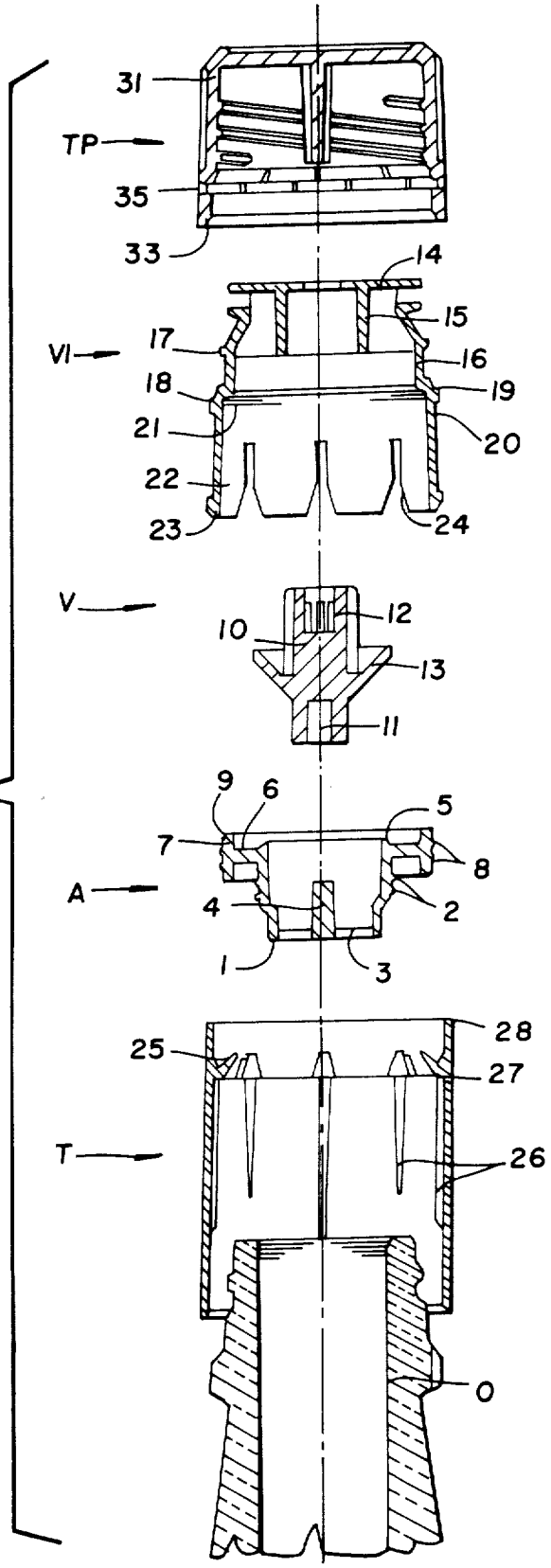
FIG. 2 is a piece-view of FIG. 1, showing every component in longitudinal-section.
Figure 3:
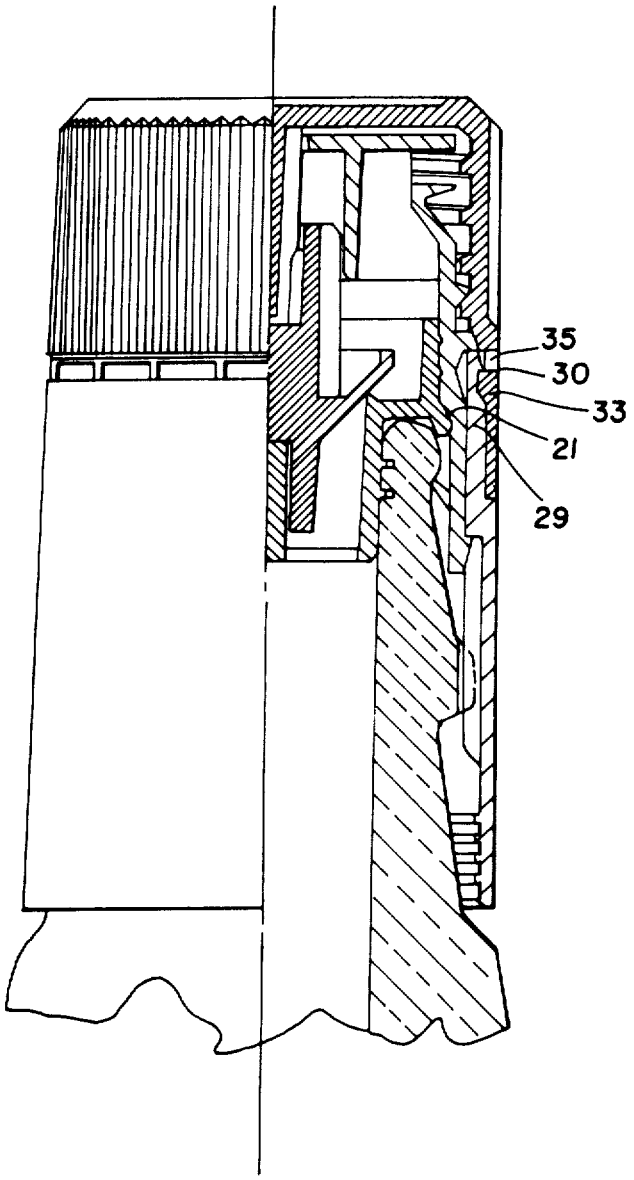
FIG. 3 is an elevation and a longitudinal-section-view of a second modality of the improved, non-refillable and inviolable cap claimed hereby, showing all of its components intercoupled.

Referring to FIGS. 1 to 3, the improved, non-refillable and inviolable cap claimed hereby consists of a combination of:

a valve-seat A, made out of plastic material, composed of a brim 1 which gradually diminishes its diameter by its lower end, and which has a pair of external, annular flanges 2, a hollow, annular bottom 3, with a vertical, cylindrical projection 4 upward-oriented, a relatively flexible, annular seat-flange 5', an annular seat-wall 6, and a retention-member encompassing two external, annular flanges 8 and in the first modality, illustrated in FIGS. 1 and 2, an external interlocking-surface 9 on its upper end, and, in the second modality, illustrated in FIG. 3, an outward-oriented interlocking-surface 9', on its lower end;

A valve V made out of plastic material, composed of a cylindrical body 10 with a lower cylindrical cavity 11 ending conically, an upper cavity 12 and a conical, annular valve 13 surrounding the cylindrical body 10;

An integral spout VI made out of plastic material, composed of an upper wall 14 from which pends downwardly a guiding ring 15, an annular wall 16 with an external threading 17, an external, annular flange 18 featuring two interlocking surfaces 19 and 20, an internal, interlocking-surface 21, in the modality illustrated in FIGS. 1 and 2 is located approximately at the height of the annular flange 18 and that, in the modality illustrated in FIG. 3, is located in the middle part of the spout, and a plurality of proturberances (legs) 22, each of them having an external, interlocking-surface 23 and being separated by a plurality of openings 24;

An integral interfastening-tube T made out of plastic material, encompassing: a plurality of relatively flexible and upward-oriented interlocking proturbences (legs) 25, a plurality of vertical, fastening-ribs 26, and an internal surface 27 which, in the modality illustrated in FIGS. 1 and 2 ends in an upper, interlocking-surface 28 and which, in the modality of FIG. 3 continues upwards in a ring 29 having a fastening flange 30 on its upper, external part; and An integral cap TP made out of plastic material, composed of a top-cap portion 31 with an internal threading 32, a downward-oriented, pending pivot P and an annular lapping 33 featuring an internal, salient portion on its upper part 34 which, in the modality illustrated in FIGS. 1 and 2 is relatively narrow, in comparison to the one illustrated in the modality of FIG. 3, which is relatively wider and is united entirely to the top-cap portion 31 by a plurality of breakable reticula 35.

INTERCOUPLING OF COMPONENTS

The assembling of the cap may be directly made on the container filled with the product or, as it seems more logical, by assembling the cap in advance and later introducing it in a single operation in the filled container, which is the usual way.

In this manner, the valve V is coupled to the seat A by the cooperation of the cylindrical projection 4 of the seat A which penetrates loosely through the lower cavity 11 of the valve V, as a guiding and retaining means for the latter, and its conical wall 13 is seated on the flexible flange 5 of the seat A, bending said flange when exerting a light pressure on the valve V.

The spout VI is introduced through the seat A or vice versa, thus being withheld against sliding downwards, by the combination of the interlocking surface 9 or 9' of the A seat's retention-ring 7 and the interlocking surface 21 of the spout VI, and being firmly and hermetically fastened by the annular flanges V of said retention-ring 7.

The tube T is introduced through the upper part of the spout VI, bending lightly its fastening protuberances (legs) 25 until passing and being interlocked by the combination of the mentioned protuberances 25 which pass through the openings 25 of the spout VI and through the interlocking surfaces 27 of the tube T and the interlocking flange 23 of the spout VI, thus being withheld against rotation by the ribs which cooperate with the brim 13 of the E container's neck, as illustrated in the modality of FIGS. 1 and 2 and, by means of the upper, interlocking-surface 30 of the ring, it is interlocked against the external, interlocking-flange 18 of the spout VI, as in the modality of FIG. 3. This tube T may also be introduced into the spout through its lower part, bending lightly the protuberances (legs) 22 of the spout VI by the upper part of the tube T, until being interlocked in the manner already explained.

Finally, the cap TP is introduced by using the threading-into the spout VI, forcing it to pass through the flange 18 with the cooperation of the conical part which rests on said flange 18, so as to be interlocked by the cooperation of the upper surface 19 of the flange 18 against the lower flange of the top-cap portion 31 and the lower, interlocking-surface 20 of the flange 18 of the spout VI against the upper, interlocking-surface of the ring 34 of the cap TP and by the upper, interlocking-surface 28 of the tube T, against the lower flange of said ring of the cap TP, as in the illustrations of FIGS. 1 and 2; or to be rather withheld by the fastening portion 30 of tube T which stops against the lower surface of the flange 18 of the spout VI, and the upper surface of the ring 33 of said cap TP, as in FIG. 3; on the other hand, the pivot P of the top-cap portion 31 penetrates loosely through the upper cavity of the valve V, in order to exert a light pressure on this, so as to fix it on the flange 5 of seat A, bending it a little and thus sealing the container hermetically and leaving it leakage-proof.

In this way, the set of the improved, non-refillable and inviolable cap claimed hereby, may be assembled onto the container E by introducing such set in a manner whereby the protuberances (legs) 25 of the tube T are lightly bent and by introducing the ring 1 into the orifice O of the base or neck of the container E, in order to be firmly and hermetically withheld when fastened onto the container by the flange 2 of the ring 1 of seat A, as well as securely interlocked when the protuberances (legs) stop against the lower flange of the container's neck, thus permitting later and by a light turning-effort to break the reticula 35 in order to separate the top-cap portion 31, leaving the rest of the set firmly fastened to the container, and thereby providing it effectively with the desired features of non-refillability and inviolability.

As the experts in the field may infer from the above description which shall always be construed as explaining the invention by way of illustration and not of limitation thereof, changes may be made as to the design and order of placement of the parts which compose this cap, same which, however, shall fall and be contained within the true scope and intendment of this invention, hereafter claimed, pursuant to the following clauses.

I claim:

1. Improved, non-refillable and inviolable cap for bottles and similar containers, featured by and including a combination of: a valve-seat for coupling hermetically to the mouth of the container, and which encompasses a relatively flexible valve-seat flange, a hollow-bottom to allow the flow of the receptacle's contents, a guiding, central and vertical projection, and an annular retention-member including an interlocking-surface on one end; a valve having a central cavity on each of its ends, one of which is loosely coupled into the vertical projection of the seat, and a conical sealing-wall which surrounds it and which rests on the valve-seat flange; an externally-threaded spout, embracing a flange in the middle thereof, an internal, interlocking-surface, a plurality of protuberances (legs), all of them having an external interlocking-flange on their lower ends, and an internal, central ring pending from the upper wall, in order to guide and withhold the valve when open, a fastening-tube encompassing a plurality of relatively flexible internal fastening-protuberances, passing through the spout's protuberances (legs), so as to interlock against the brim of the container's neck to prevent if from sliding upwards, a plurality of interlocking-surfaces, one of which interlocks with the flange of the spout's protuberances (legs), to hamper it from sliding downwards, and a plurality of internal, vertical fastening ribs, which cooperate with the flange of the container's neck, hindering it from revolving around the container; and a cap threaded internally towards the spout, including a central pivot pending from its upper wall, and penetrating through the upper cavity of the valve, in order to push and retain the valve, sealing it against the seat-flange, a portion of annular lapping entirely united to the cap by a plurality of breakable reticula, lapping which includes a plurality of interlocking-surfaces that permit it to interlock directly or indirectly with the spout and/or the tube.

2. Improved, non-refillable and inviolable cap, as described in clause 1, featured by a valve-seat including annular flanges in the tube-portion thereof and/or in the seat-portion against the container, so as to seal and fasten to the orifice of the container.

3. Improved, non-refillable and inviolable cap, as described in clause 1, featured by a seat-retention member including a plurality of external flanges for retaining the spout, and by the internal, interlocking-surface which cooperates with the internal, interlocking-surface of the spout and is located whether on the upper or lower end thereof.

4. Improved, non-refillable and inviolable cap, as described in clause 1, featured by a plurality of interlocking-surfaces consisting of an upper, interlocking-surface which is to interlock with the lower surface of the portion of lapping of the cap, and an internal, lower interlocking-surface which is to clog with the interlockinng-flange of the spout's protuberances (legs).

5. Improved, non-refillable and inviolable cap, as described in clause 1, featured by a plurality of interlocking-surfaces of the tube consisting of a relatively wide ring having an external, lower interlocking-surface which clogs with the lower interlocking-surface of the lapping portion of the cap, an upper, interlocking-surface clogging with the lower surface of the middle flange of the spout and an interlocking-flange on its external, upper end, which clogs with the upper, interlocking-surface of the cap's lapping.

6. A closure for a container having a neck, such as a bottle, including:

a first member for positioning over said neck and which has circumferentially-spaced axially-extending legs having outwardly-extending locking members formed integrally therewith; and, a second member for positioning over said neck, and which includes inwardly-extending locking members for engagement with an enlargement of said container neck, said inwardly-extending locking members being receivable between said legs of said first member, and which also includes inwardly-extending abutments for locking engagement with the outwardly-extending locking members of said first member.

7. The closure member of claim 6, in which said first member is a spout member housing a refill-inhibiting one-way valve.

8. The closure of claim 7, in which said one-way valve includes a valve seat insertable into the neck of the container, and a valve member for cooperation with the valve seat and which is conjointly supported by said spout member and said valve seat for movement relative to said valve seat.

9. The closure of claim 8, in which said first member is externally threaded for the reception of an internally threaded removable cap, said cap including an internal presser member for engagement with said valve member to force said valve member onto said valve seat.

10. The closure of claim 6, in which said first member is a spout member and is externally threaded for the reception of an internally threaded removable cap, said first member having an outwardly-extending shoulder for engagement by an inwardly-extending shoulder of a securing ring interconnected with said removable cap by rupturable means.

* * * * *